United States Patent [19]

Deutsch

[11] 4,121,490

[45] Oct. 24, 1978

[54] TOUCH RESPONSIVE ELECTRONIC PIANO

[75] Inventor: Ralph Deutsch, Sherman Oaks, Calif.

[73] Assignee: Kawai Musical Instrument Mfg. Co. Ltd., Hamamatsu, Japan

[21] Appl. No.: 789,063

[22] Filed: Apr. 20, 1977

[51] Int. Cl.[2] ..... G10H 1/00

[52] U.S. Cl. ..... 84/1.27; 84/1.1; 84/DIG. 7

[58] Field of Search ..... 84/1.01, 1.03, 1.27, 84/DIG. 7, 1.26, 1.09, 1.1

[56] References Cited

U.S. PATENT DOCUMENTS

| | | | |
|---|---|---|---|
| 2,790,043 | 4/1957 | Clason | 200/83 J |
| 3,344,625 | 7/1968 | Grow | 84/DIG. 7 |
| 3,705,254 | 12/1972 | Amano | 84/DIG. 7 |
| 3,708,605 | 1/1973 | Ohno | 84/DIG. 7 |
| 3,835,235 | 9/1974 | Amano | 84/1.01 |
| 3,845,683 | 11/1974 | Lehmann | 84/1.01 |
| 3,908,504 | 9/1975 | Deutsch | 84/1.27 |
| 3,939,316 | 2/1976 | Stropkay | 200/83 J |
| 4,018,125 | 4/1977 | Nishimoto | 84/1.26 |
| 4,033,219 | 7/1977 | Deutsch | 84/1.03 |
| 4,052,924 | 10/1977 | Deutsch | 84/1.03 |

*Primary Examiner*—Robert K. Schaefer
*Assistant Examiner*—William L. Feeney
*Attorney, Agent, or Firm*—Christie, Parker & Hale

[57] ABSTRACT

A keyboard operated polyphonic tone synthesizer which is touch responsive to the force applied to the keyboard mechanism. Operation of a key operates through a pneumatic transducer to provide an air stream having a velocity proportional to the force applied to the key. A transducer responsive to the velocity of the gas produces an output pulse having a peak amplitude proportional to the peak velocity of the air. This voltage in turn is used to control the peak amplitude of a musical tone generated in response to the operation of the key so that a direct relation exists between the force with which the key is operated and the amplitude of the resulting sound generated by the instrument.

9 Claims, 5 Drawing Figures

TOUCH RESPONSIVE ELECTRONIC PIANO

FIELD OF THE INVENTION

This invention relates to electronic keyboard operated musical instruments, and more particularly it is concerned with a touch responsive keyboard instrument.

BACKGROUND

An electronic instrument designed to duplicate electronically the percussive qualities of a piano requires that the tone generators be touch responsive, that is, the force with which the keys are struck must control the peak amplitude of the tone generated in response thereto. While various so called electronic pianos are available on the market which are, to a degree, touch responsive, they do not effectively duplicate the acoustic piano. To even approximate the touch of a conventional piano, the mechanical characteristics as well as the acoustical characteristics associated with the key action of piano must be duplicated. While various touch responsive transducers have heretofore been proposed, they have not proved entirely satisfactory either from the standpoint of high initial cost and/or the difficulty of maintaining the transducers in accurate adjustment. Since a separate transducer is required for each key, stability of the transducer and cost of the transducer become critical. Velocity sensing devices have been used, for example, such as magnets moving relative to an inductance coil for inducing a voltage proportional to velocity of motion have been used. However, known instruments of this type have not provided the necessary mechanical feel or the tone characteristics of a piano.

SUMMARY OF THE INVENTION

The present invention is directed to a touch responsive electronic instrument incorporating a velocity responsive transducer which can be manufactured at relatively low cost and which is not sensitive to changes in ambient conditions and therefore requires no accurate adjustment. The signal generated by the transducer can be used to control the peak amplitude of an electronically generated tone having The tone qualities of a mechanically struck string produced by the conventional acoustic piano. The transducer provides the mechanical feel of resistance to the force at which the key is struck.

This is accomplished, in brief, by providing a keyboard operated electronic instrument in which each key is connected to a touch responsive transducer including a pneumatic dashpot in which a piston, connected to a key, forces air through an orifice by compressing the air in the dashpot when the key is struck. The velocity of the air escaping through the orifice is a direct function of the force with which the key is struck. A dynamic microphone positioned at the output of the orifice produces an output signal in response to the impinging air on the diaphragm of the microphone, the peak amplitude of which is a direct function of the peak velocity of the gas escaping through the orifice. The dashpot provides the necessary resistance to the force to simulate the feel of a conventional piano. The voltage pulse generated by the transducer is preferably used in combination with a polyphonic tone synthesizer having an ADSR generator capable of reproducing the percussive characteristics of a piano in the generated tones.

DESCRIPTION OF THE DRAWINGS

For a better understanding of the invention, reference should be made to the accompanying drawings wherein.

DETAILED DESCRIPTION

Figure 1:
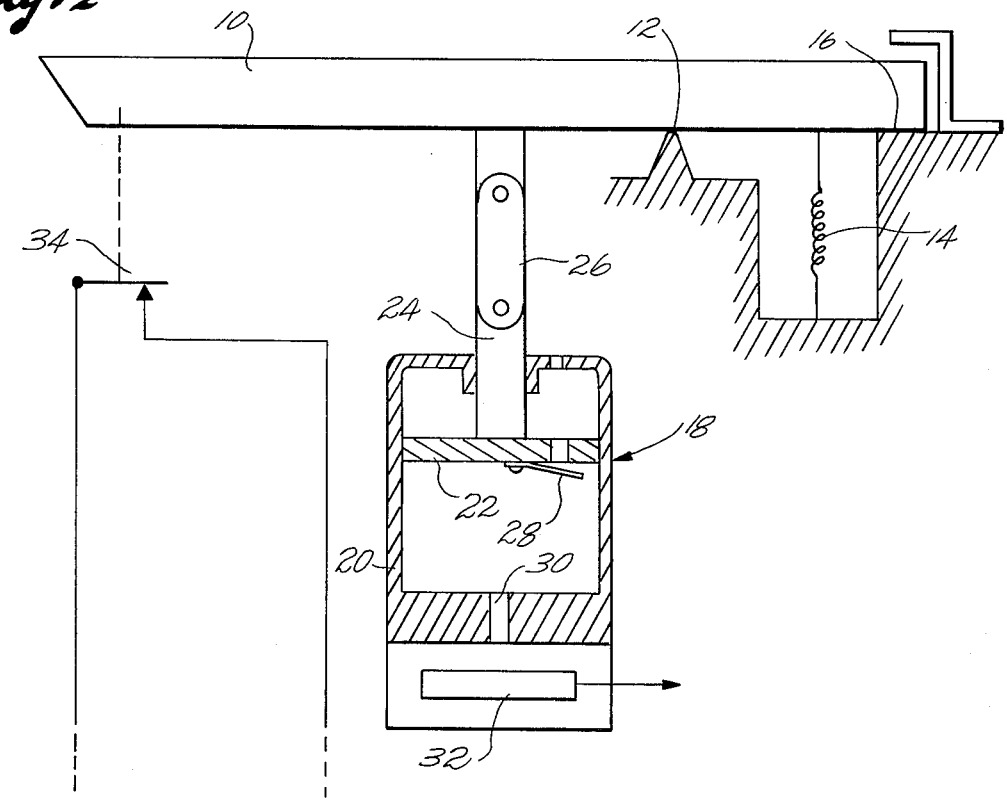
FIG. 1 is a cross sectional view of a transducer according to the present invention.

Referring to FIG. 1, there is shown schematically one key, indicated at 10, of a keyboard operated musical instrument. The key is pivoted on a fulcrum 12. A tension spring 14 holds the key against the fulcrum 12 and against a stop 16. The key 10 is linked to a transducer indicated generally at 18. The transducer is in the form of a dashpot assembly including an outer housing 20 forming a cylinder in which is slidably positioned a piston 22. The piston is connected to the key 10 by means of a rod 24 and link 26. A check valve 28 may be provided to admit air to the cylinder during the return or upward stroke of the piston 22. However, when the key is depressed, the valve 28 closes and the air trapped in the cylinder is compressed. The compression of the air plus the increased tension of the spring 14 provides resistance to the force applied to the key, producing the desired feel for the person operating the keys.

The air, as it is compressed in the cylinder, is forced out through a small orifice 30. The orifice acts to magnify the velocity of the escaping air, the magnification being determined by the ratio of the diameter of the cylinder to the diameter of the orifice. The air escaping through the orifice 30 impinges against the diaphragm of a dynamic microphone 32 positioned directly opposite the orifice exit. Thus, the escaping gas impinges on the diaphram, displacing the diaphragm and producing a voltage transient at the output of the microphone. The microphone preferably is a velocity responsive or dynamic microphone, preferably an electret type microphone. The electret microphone produces a voltage transient whose peak value is a direct function of the velocity of the gas escaping through the orifice, which in turn is a function of the force with which the key is actuated. The voltage waveform at the output of the microphone 32 is shown by waveform (B) in FIG. 3.

Also associated with each key, as shown in FIG. 1 is a switch 34 having normally open contacts which are closed when the key 10 is depressed. Switch 34 remains closed until the key is released. The open and closed conditions of the switch 34 are represented by the waveform (A) in FIG. 3.

Figure 2:
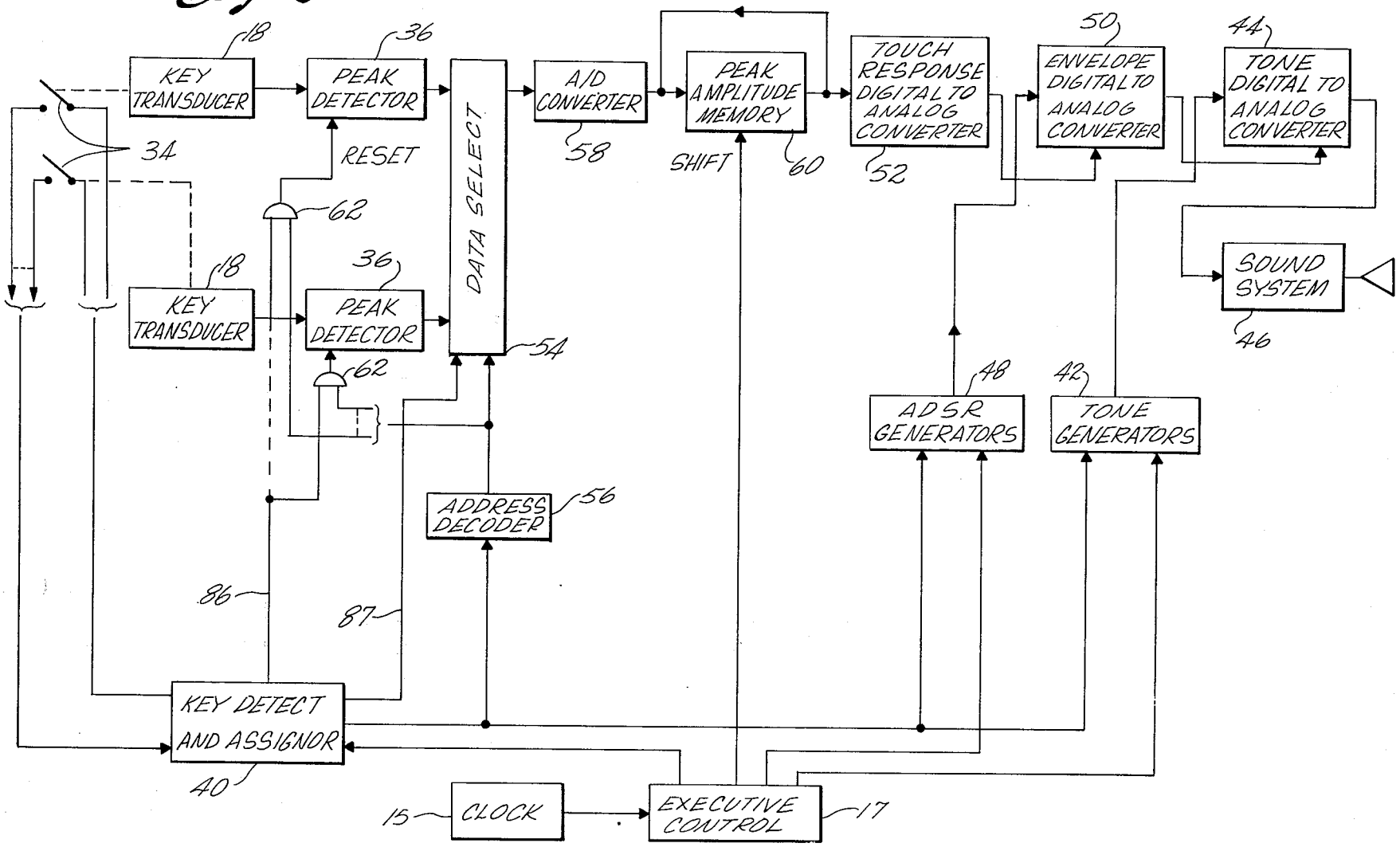
FIG. 2 is a schematic block diagram showing the transducer in combination with a polyphonic tone synthesizer.

Referring to FIG. 2, the circuit for generating sounds in response to operation of the keys using the transducer of FIG. 1 is shown schematically. In the keyboard instrument, each key has associated with it a key transducer 18 of the type described in FIG. 1. The output signal from the electret microphone of each key transducer is connected to its own peak amplitude detector 36. The peak detector holds the output level at the peak voltage of the input, as shown by waveform (C) of FIG. 3. In a standard piano type keyboard there would be up to 88 separate key transducers 18 and associated peak detector circuits 36.

The output signals from peak detectors 36 in combination with the key operated switches 34 are used to control a polyphonic tone synthesizer preferably of the type described in detail in copending application Ser. No. 603,776, filed Aug. 11, 1975, entitled "Polyphonic Tone Synthesizer", incorporated herein by reference. This application describes a digital computer organ having a plurality of tone generators, each tone generator having a computation mode in which data defining the relative amplitudes of a plurality af sample points of a desired musical waveshape are calculated. As is described in the said copending application, a key detect and assignor circuit 40 senses when any of the switches 34 is closed by depression of the keys and stores the information as to which switches have been closed. The key detect and assignor circuit 40 is described in detail in copending application Ser. No. 619,615, filed Oct. 6, 1975, entitled "Keyboard Switch Detect and Assignor", and is incorporated herein by reference. It then assigns tone generators to each of the associated keys, the number of available tone generators being a function of the design of the instrument. When a key is released, the key detect and assignor circuit 40 releases the tone generator so that it can be reassigned to a subsequently operated key.

The tone generators, indicated generally at 42, in response to the information stored in the key detect and assignor circuit 40 as to which key is depressed and assigned to the tone generator, generate digitally coded information representative of points on the waveform of the audio signals to be generated. The digital information from the tone generators is applied to a tone digital-to-analog converter 44 on a time shared basis under the control of an executive control 17 and master clock 15 in a manner described in detail in the above identified patent application Ser. No. 603,776. The digital information is converted to an analog voltage having the desired audio waveform for driving and audio sound system 46.

In order for a tone generated by a tone generator to produce a sound characteristic of a percussion instrument, for example, such as the piano where the string is struck by a hammer, the envelope of the audio signal must be shaped to correspond to the sharp attack and decay of the percussive sound. Also, the time that the tone is sustained must be controlled to duplicate the effect of the sustaining peddle on the piano, for example. The attack, decay, sustain and release characteristic of the generated tones is controlled by an ADSR generator 48, preferably of the type described in detail in copending application Ser. No. 652,217, filed Jan. 26, 1976, entitled, "ADSR Envelope Generator", and incorporated herein by reference. The ADSR generator 48 generates digital information indicative of the desired shape of the envelope of the tones being generated. This data is applied to an envelope digital-to-analog converter 50. The output of the envelope digital-to-analog converter 50 is applied to the tone digital-to-analog converter 44 to control the gain at the output. Thus the output voltage of the digital-to-analog converter 50 operates to modulate the amplitude of the audio signal generated at the output of the digital-to-analog converter 44, all in the manner described in detail in the above-identified patent applications.

According to the present invention, the gain of the envelope digital-to-analog converter 50 is similarly controlled by the output of a touch response digital-to-analog converter 52 so as to control the magnitude of the output signal from the envelope digital-to-analog converter 50 in response to the peak voltage levels derived from the peak detectors 36.

To this end, the output voltages from each of the peak detectors 36 are applied to respective inputs of a data select switching circuit 54 which selectively connects any one of the plurality of inputs to an output in response to address signals from the key detect and assignor circuit 40 indicating which key has been actuated. Whenever a key 10 is actuated and one of the switches 34 is closed, the key detect and assignor circuit generates a signal on a line 87 indicating that a key is depressed. At the same time, the key detect and assignor circuit provides a digitally coded address identifying which key has be actuated. The key detect and assignor circuit includes an assignment memory in the form of a shift register which stores the information on each note whose key is currently depressed. This address information is decoded by an address decode circuit 56 and applied to the data select circuit 54 along with the signal on the line 87. The data select circuit 54, in response to the decoded address selects one of the inputs, corresponding to the particular key which has been actuated, and, at a time determined by the signal on the line 87 connects the input derived from a particular one of the peak detectors 36 to the input of an analog-to-digital converter 58.

The digital output of the analog-to-digital converter 58 is stored in a peak amplitude memory, preferably in the form of a shift register 60. The peak amplitude memory 60 stores one word for each key that is depressed, the word being coded to indicate the relative amplitude of the signal from the output of the associated peak detector 36. The peak amplitude register is shifter in synchronism with the assignment memory in the key detect and assignor circuit 40 from the clock 15 by the executive control 17. The peak amp tude memory stores one word for each key that is depressed and is shifter in synchronism with the amplitude shift register of the ADSR generator 48 described in the above identified application Ser. No. 652,217. This synchronism of the respective shift registers permits the three digital-to-analog converters to be time shared in generating polyphonic tones.

In operation, when a key is actuated, a pulse is generated from the output of the associated electret microphone in the key transducer 18. The voltage pulse is applied to the peak detector 36 which sustains the peak voltage in a capacitor until the peak detector is reset at the time the associated key is released. The resetting of the peak detector by discharging the associated capacitor in the detector is accomplished by a release signal generated on an output line 86 from the key detect and assignor circuit 40 in the manner described in the above identified application Ser. No. 619,615. At the same time that the signal appears on the output line 86, the key detect and assignor circuit 40 generates a digital output coded to identify the particular key being released, which information is decoded by an address decoder 56 for addressing a respective one of the peak detectors 36. The address decoder 56 has one output line for each key, each output line being applied to a respective one of a plurality AND circuits 62 which gate the output signal on the line 86 to the reset input of the corresponding one of the peak detectors. The waveform of the output of the respective peak detectors is shown at C in FIG. 3.

From the above description of FIGS. 1 and 2 it will be seen that a touch sensitive tone generator is provided in which the amplitude and hence the loudness of each tone generated is directly related to the force applied to the key. The pitch and tone quality of the audio output are controlled by the tone generator and the attack-/decay characteristic of each tone is controlled by the ADSR generator. The combination of three controls, namely, tone, attack/decay, and touch responsive loudness (peak amplitude) makes it possible to reproduce the characteristics of an acoustic piano.

Figure 3:
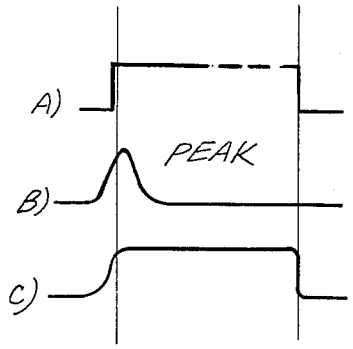
FIG. 3 is a series of waveforms used in explaining the operation of the circuit of FIG. 2.
Figure 4:
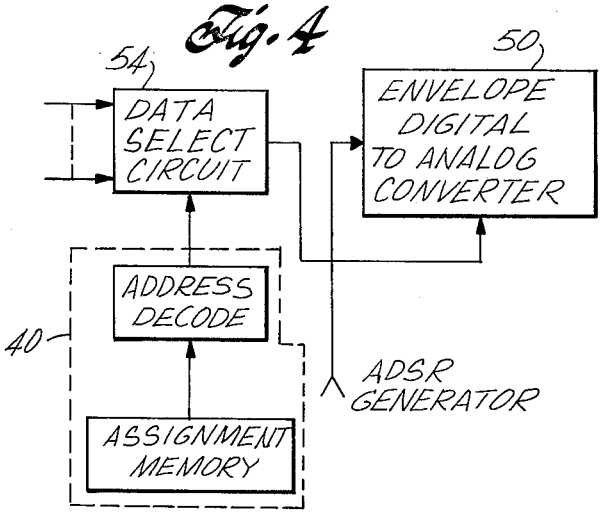
FIG. 4 is an alternative embodiment of the invention in an instrument having a sustained repeat feature.

An alternative embodiment is shown in FIG. 4 which eliminates the analog-to-digital conversion and peak amplitude memory FIG. 2 by using the analog voltages to directly control the envelope digital-to-analog converter 50. As shown in FIG. 4 this is accomplished by connecting the output of the data select switching circuit 54 directly to the voltage control input of the envelope digital-to-analog converter 50. Time sharing of the converter 50 among the several notes being generated is provided because the assignment memory in the key detect and assignor circuit, as described above, continously shifts out the information identifying each of the notes in sequence. Thus, the output of one peak detector 36 at a time is applied to the voltage control input of the digital-to-analog converter 50 and this time is synchronized with the time the ADSR generator is generating the envelope amplitude for the corresponding note. Because the peak detectors 36 retain the peak voltage during the time the corresponding key is depressed, as shown by the waveforms of FIG. 3, the peak detector acts as an analog memory. The data select circuit 54 must be capable of switching analog voltages from any of the peak detectors 36 to the control input of the envelope digital-to-analog converter 50.

Figure 5:
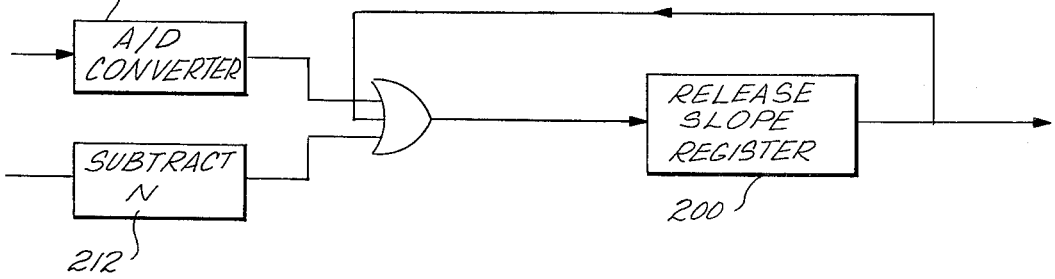
FIG. 5 is an alternative embodiment to the circuit of FIG. 2.

The touch responsive feature of the present invention may also be incorporated in a polyphonic tone synthesizer having a sustained repeat as described in detail in copending application Ser. No. 712,745, filed Aug. 9, 1976, entitled "Sustained Repeat", which is herein incorporated by reference. Referring to FIG. 5, the manner in which the touch response is incorporated with the sustained repeat function is disclosed. The sustained repeat circuit described in the above identified copending application includes a release slope register 200 which stores information on the envelope amplitude of each note being generated. When a key is actuated and a new note is initiated by the tone generator, an associated word in the release slope register 200 is initiallized to provide a unity scale factor at the start of the sustained repeat operation. Each time the note is automatically repeated by the sustained repeat circuit, this amplitude information is decremented by a substract-N circuit 212. To incorporate touch response in the sustained repeat circuit, the unity scale factor stored in the release slope registor 200 is replaced by the peak amplitude information reveived from the output of the analog-to-digital converter 58. Thus, the release slope register 200 functions as the peak amplitude memory described in connection with FIG. 2.

From the above description it will be seen that a touch responsive tone synthesizer that can generate percussive sounds which are controlled in response to the force with which the keys are struck has been provided. By combining the touch responsive feature with an ADSR generator which duplicates the envelope waveform of a piano string struck by a hammer and by designing the tone generator to produce the tone quality of a vibrating string, the polyphonic tone generator can substantially duplicate the characteristics of a conventional acoustic piano to a degree not heretofore achieved by electronic instruments.

What is claimed is:

1. A touch responsive transducer for an electronic music system, such as a piano or the like having a keyboard, comprising a pneumatic cylinder including a piston adapted to be connected to a key, the cylinder having an orifice discharging gas from the cylinder under compression by the piston when the associated key is actuated, and means sensing the velocity of the gas escaping through the orifice and generating an output signal where the magnitude varies in direct relation to the velocity of the escaping gas, said output signal controlling a characteristic of the electronic music system.

2. Apparatus of claim 1 wherein said means sensing the velocity of the gas includes an electret type microphone having a diaphragm positioned adjacent the orifice, the gas escaping through the orifice impinging on the diaphragm of the microphone.

3. Apparatus of claim 1 further including check valve means for admitting gas rapidly into the cylinder when the associated key is released.

4. Apparatus of claim 1 further including a peak detector circuit coupled to the output of the velocity sensing means for generating an output signal proportional to the peak magnitude of the signal generated by the velocity sensing means.

5. An electronic touch responsive keyboard instrument comprising transducer means associated with each key of the instrument for generating an output signal indicative of the peak velocity of the key when struck, said transducer means including a dashpot for controlling the velocity of the key in response to the applied force to provide a touch reaction to the operation of the keys, a plurality of tone generators, each tone generator producing an alternating audio frequency signal having a predetermined waveshape, means responsive to actuation of any one of the keys for operating one of the tone generators at a fundamental frequency determined by the particular key actuated, envelope generating means associated with the tone generator for varying the envelope of the alternating signal in a predetermined manner while the particular key remains actuated, and means responsive to said output signal from the transducer means for controlling the amplitude level of the envelope generating means in direct relation to the peak velocity of the actuated key, whereby the relative envelope amplitude of the generated tone is controlled by the key velocity independently of the shape of the envelope of the generated tone.

6. Apparatus of claim 5 further including means storing the peak velocity output signals while the associated keys remain actuated.

7. Apparatus of claim 6 wherein said storing means stores the peak velocity output signals in digital form.

8. Apparatus of claim 5 wherein said transducer means includes damping means for controlling the velocity of the key in response to the applied force to provide a touch reaction to the operation of the keys.

9. Apparatus of claim 5 wherein the dashpot includes means forcing a gas through an orifice, said transducer means including means sensing the velocity of the gas passing through the orifice.

* * * * *